United States Patent [19]

Landa

[11] 4,286,886

[45] Sep. 1, 1981

[54] METHOD AND APPARATUS FOR CONTROLLING THE FEED OF PROJECTILES IN A MICROBALLISTIC PRINTER

[75] Inventor: Benzion Landa, Edmonton, Canada

[73] Assignee: Savin Corporation, Valhalla, N.Y.

[21] Appl. No.: 107,823

[22] Filed: Dec. 28, 1979

[51] Int. Cl.[3] ..... B41J 3/02

[52] U.S. Cl. ..... 400/118; 400/121; 124/51 R

[58] Field of Search ..... 400/118, 119, 121; 124/51 R, 51 A, 41 R; 273/355, 356, 404; 310/314; 346/141; 72/53

[56] References Cited

U.S. PATENT DOCUMENTS

| | | | |
|---|---|---|---|
| 1,309,129 | 7/1919 | Gannoe | 124/51 R X |
| 2,837,076 | 6/1958 | Koci et al. | 124/51 R X |
| 4,164,183 | 8/1979 | Peck | 51/424 X |

*Primary Examiner*—Paul T. Sewell

*Attorney, Agent, or Firm*—Shenier & O'Connor

[57] ABSTRACT

My invention comprises a ballistic impact printer which includes a gun for successively propelling balls to a printing medium spaced from the gun. The balls are fed to the printer from a reservoir and recycled to the reservoir after they have performed their impact-printing function. I provide a bleeder duct for the projectiles intermediate the projectile feeder and the gun. When no printing occurs, the balls are deflected to the bleeder duct and never reach the gun. When printing is desired, the bleeder duct is blocked in order to constrain the projectiles to be fed to the gun, past a deflector which normally diverts the projectiles to the bleeder duct. The gate is a rapidly acting, electrically actuated assembly employing a piezo crystal or crystals, an electromagnet, or a solenoid. The deflector is positioned in the feeding duct and may be spring-loaded so it will yield when the gate is closed.

6 Claims, 5 Drawing Figures

METHOD AND APPARATUS FOR CONTROLLING THE FEED OF PROJECTILES IN A MICROBALLISTIC PRINTER

BACKGROUND OF THE INVENTION

In my copending application, Ser. No. 39,372, filed May 15, 1979, now abandoned I disclose a microballistic printer in which a plurality of solid projectiles are propelled from a gun for free flight to a platen spaced from the gun. A paper, or other sheet material, is fed across the platen beneath a printing medium. The gun is so controlled that the projectiles striking the printing medium will produce the desired pattern. The projectiles in my microballistic printer are shown as tungsten carbide balls, about 0.800000±0.000001 mm. in diameter. These may be fed to the gun at the rate of about two thousand per second. The balls are fed to the gun by a feeder which may be a toothed rotating member. A counter is provided for stopping the feeding of balls to the gun after the number of balls necessary for a program or sub-program being printed have been fired. This requires the starting and stopping of the projectile feeder, entailing the use of large forces.

FIELD OF THE INVENTION

My invention relates to a novel method and apparatus for controlling the feed of projectiles in a microballistic printer to a gun which fires the projectiles along predetermined paths to produce the desired printing pattern.

SUMMARY OF THE INVENTION

In general, my invention contemplates the provision of a microballistic printer in which projectiles are continuously fed toward a gun, past a gating assembly which diverts the projectiles from the feeding duct before they reach the gun when no printing is being carried on. When it is desired that printing take place, the gating assembly is actuated to prevent venting of the balls. The feeder then feeds projectiles to the gun until the desired pattern is printed.

OBJECTS OF THE INVENTION

One object of my invention is to provide a method and apparatus for controlling the feeding of projectiles to the gun of a microballistic printer in a novel and expeditious manner.

Another object of my invention is to provide a method and apparatus for controlling the forced feeding of projectiles to the gun of a microballistic printer by a gating assembly adapted to act at a very high speed with the application of low force.

Still another object of my invention is to provide a gating assembly which responds very rapidly with substantially no movement of the parts.

A further object of my invention is to provide a gating assembly for controlling the feeding of projectiles to the gun of a microballistic printer in which the mechanical time constant of the assembly is substantially zero.

An additional object of my invention is to provide a method of controlling the feeding of projectiles in a microballistic printer where projectiles are constantly recycled from a reservoir to the gun of the microballistic printer and back to the reservoir, in which I interrupt the feeding of projectiles to the gun by a gating assembly which diverts the projectiles between the feeding station and the gun station when no printing is desired.

Other and further objects of my invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figure 1:
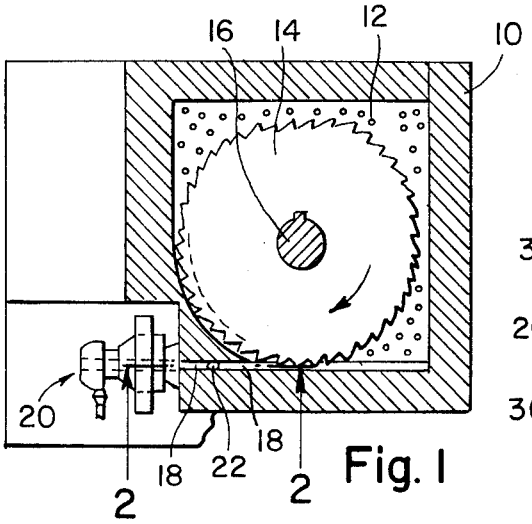
FIG. 1 is a sectional plan view of the feeding arrangement which feeds balls from a projectile reservoir to a gun assembly of a microballistic printer.

Referring now to the drawings and, more particularly, to FIG. 1, a projectile reservoir 10 contains a quantity of projectiles 12 which may be metal balls. On the bottom of the reservoir, I position a toothed feeding plate 14 rotated by shaft 16 to which it is keyed. The teeth of the feeding plate 14, which rotates in the direction of the arrow, force projectiles into a feeder tunnel 18. Projectiles are adapted to be fed to a gun assembly, indicated generally by the reference numeral 20, past a bleeder duct 22 which forms part of the gating assembly. When the gate is closed, projectiles continue through feeder duct 18 to the gun assembly from which they are propelled. The gun is controlled as described in my copending application, above referred to, to produce the desired pattern of printing.

Figure 2:
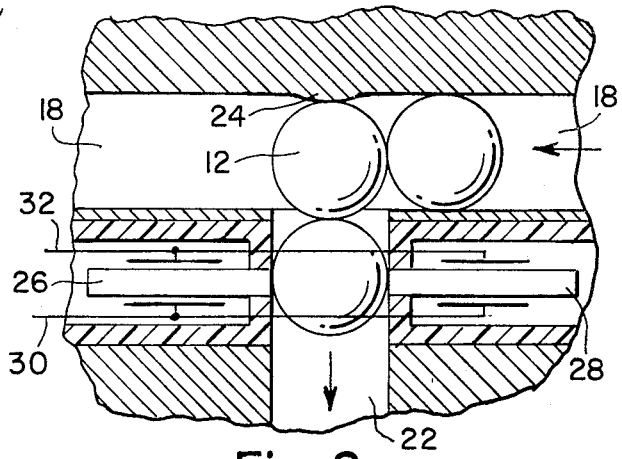
FIG. 2 is a sectional view, taken along the line 2—2 of FIG. 1, drawn on an enlarged scale, of one form of gating assembly embodying my invention and adapted to be used in carrying out the method of my invention.

Referring now to FIG. 2, it will be noted that the bleeder duct 22 communicates with the feeder duct 18 at a point intermediate the feeder and the gun. Just above the bleeder duct 22, I provide a deflector 24 in the tunnel 18. This deflector will produce a downward vector force on that ball 12 directly over the venting tube 22. As can be seen by reference to FIG. 2, normally the balls from the feeding tunnel will not pass to the gun, but will be bled through venting duct 22, from which they will be recycled to the reservoir, as shown in my copending application above referred to. In FIG. 2, I have shown a pair of piezoelectric crystals 26 and 28 adapted to be energized from a voltage source (not shown) through conductors 30 and 32. It will be recalled that, in one embodiment of my invention, the balls 12 are made of tungsten carbide and are finished to a diameter of 0.800000±0.000001 mm. Accordingly, the diameter of the duct 22 adjacent the crystals should be finished to a tolerance of 0.800001±0.000001 mm. The diameter of the rest of the venting duct is not critical. When it is desired to feed balls to the gun 20, the piezo crystals are energized to restrain the ball which happens to be passing through venting duct 22 adjacent the crystals and hold it in the position shown in FIG. 2. Since the downward vector of the force created by the deflector 24 is small, the ball 12 and succeeding balls will pass the deflector and move to the gun. In FIG. 2, the piezoelectric crystals are shown in the unenergized condition.

Figure 3:
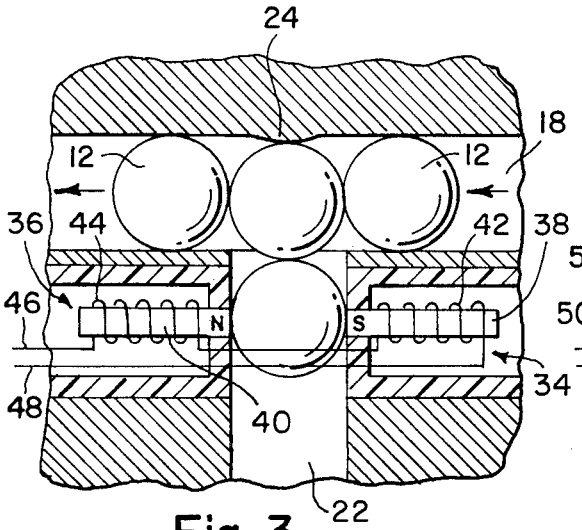
FIG. 3 is a view, similar to FIG. 2, showing another form of gating assembly embodying my invention and capable of carrying out the method of my invention.

Referring now to FIG. 3, I provide a pair of electromagnets, indicated generally by the reference numerals 34 and 36, having cores 38 and 40 around which windings 42 and 44 are positioned. The form of the invention shown in FIG. 3 may be used when the balls 12 are formed of paramagnetic material. The flux created by the windings 42 and 44, when energized through conductors 46 and 48, will restrain the ball 12 in the magnetic flux path to prevent the ball 12, which is positioned in the duct, from moving down to the venting duct 22. Thus the energization of the electromagnets 34 and 36 will cause the feeding of balls to the gun. It will be noted that, in this form of the invention, the cores 38 and 40 do not move, so that there are no moving parts in the gating assembly. In FIG. 3, the windings are shown as energized.

Figure 4:
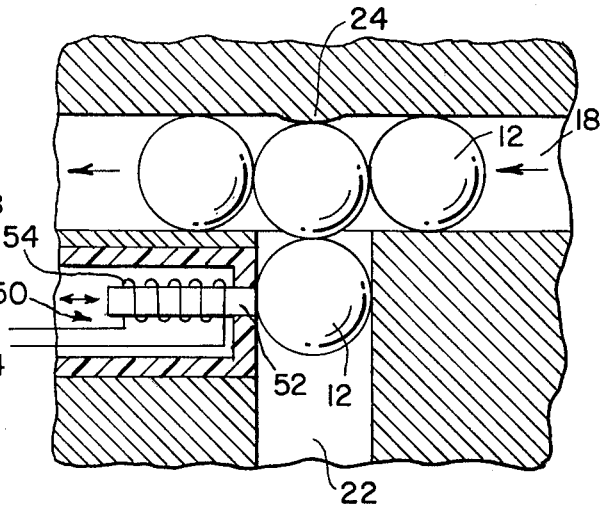
FIG. 4 is a view, similar to FIG. 2, showing still another gating assembly embodying my invention and capable of carrying out the method of my invention.

Referring now to FIG. 4, I have shown an arrangement similar to FIG. 3, except that I employ a solenoid, indicated generally by the reference numeral 50, having an armature 52 provided with a stationary winding 54. The end of the armature 52 conforms with the surface of the venting duct 22 and forms a part thereof. The arrangement is such that, when the winding 54 is not energized, the balls 12 pass through the venting duct 22 as shown in FIG. 2. Upon the energization of the winding 54, the armature 52 exercises a force against the ball 12 positioned in the venting duct 22. The solenoid force is such that it overcomes the vector of force created by the deflector 24 and prevents the ball which is in the position shown in FIG. 4 from moving out of the bleeder duct 22. The feeding mechanism will then feed balls to the gun 20.

Figure 5:
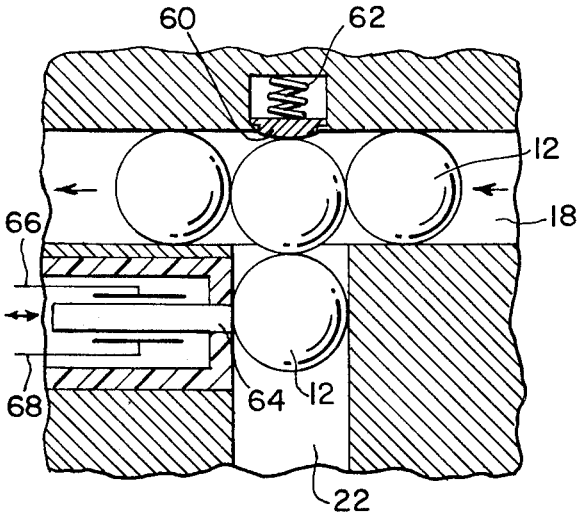
FIG. 5 is yet another form of gating assembly embodying my invention and capable of carrying out the method of my invention.

Referring now to FIG. 5, I have shown another form of deflector 60 which is urged into the duct 18 by a spring 62. Stop means limit the downward movement of the deflector 60. The balls 12 are fed as in the other forms of the invention, past the deflector for downward diversion by the spring-loaded deflector 60. A single piezo crystal 64, adapted to be energized through conductors 66 and 68, is adapted to restrain the ball 12 which happens to be opposite the crystal when it is energized. Since the downward force deflecting the balls 12 is small, the crystal, when energized, will cause the balls 12 to be fed to the gun as in the other forms of the invention. It will be understood, of course, that a spring-loaded deflector may be used in the other forms of the invention, instead of a stationary deflector.

It will be seen that I have accomplished the objects of my invention. I have provided a method and apparatus for controlling the feeding of projectiles to the gun of a microballistic printer in a novel and expeditious manner. I have provided a method of controlling the feeding of projectiles where the projectiles are constantly recycled from a reservoir to the gun of a microballistic printer and back to the reservoir, in which I interrupt the feeding of the projectiles by a gating assembly which diverts the projectiles at a point intermediate the projectile feeder and the gun when no printing is desired. I disable the gating phase with a low force which may be applied by a piezoelectric crystal, an electromagnet, or a solenoid. The mechanical time constant of my gating assembly is extremely small.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a microballistic printer in which projectiles are fed at a feeding station from a projectile reservoir to a gun for projection to a printing station and then recycled to the reservoir, a venting duct positioned between the feeding station and the gun, a deflector positioned adjacent the venting duct adapted to deflect projectiles being fed toward the gun into the venting duct before the projectiles reach the gun, a gate in said venting duct adapted to block projectiles from leaving said duct, and means for controlling said gate.

2. In a microballistic printer in which projectiles are fed at a feeding station to a gun for projection to a printing station, a venting duct positioned between the feeding station and the gun, a deflector positioned adjacent the venting duct adapted to deflect projectiles being fed toward the gun into the venting duct before the projectiles reach the gun, and a gate in said venting duct adapted to block projectiles from leaving said duct, said gate including piezoelectric means for controlling said gate.

3. In a microballistic printer in which projectiles are fed at a feeding station to a gun for projection to a printing station, a venting duct positioned between the feeding station and the gun, a deflector positioned adjacent the venting duct adapted to deflect projectiles being fed toward the gun into the venting duct before the projectiles reach the gun, and a gate in said venting duct adapted to block projectiles from leaving said duct, said gate including electromagnetic means for controlling said gate.

4. In a microballistic printer in which projectiles are fed at a feeding station to a gun for projection to a printing station, a venting duct positioned between the feeding station and the gun, a deflector positioned adjacent the venting duct adapted to deflect projectiles being fed toward the gun into the venting duct before the projectiles reach the gun, and a gate in said venting duct adapted to block projectiles from leaving said duct, said gate including solenoid means for controlling said gate.

5. In a microballistic printer in which projectiles are fed at a feeding station to a gun for projection to a printing station, a bleeder duct positioned between the feeding station and the gun, a deflector positioned adjacent the bleeder duct adapted to deflect projectiles being fed toward the gun into the bleeder duct before the projectiles reach the gun, means for resiliently mounting said deflector, a gate in said venting duct adapted to block projectiles in said bleeder duct, and electrically operated means for controlling said gate.

6. A method of controlling the printing in a microballistic printer in which projectiles are fed from a feeding station to a gun for projection to a printing station including the steps of continuously feeding projectiles in a stream from the feeding station toward the gun during a printing operation and bleeding projectiles from said stream of projectiles before the projectiles reach the gun when it is desired to stop the printing operation.

* * * * *